US006089901A

United States Patent [19]

Hatagishi et al.

[11] Patent Number: 6,089,901

[45] Date of Patent: Jul. 18, 2000

[54] CRIMP CONNECTOR HAVING STEPPED PARTITION WALLS

[75] Inventors: Yuji Hatagishi; Kazuhiko Takada; Kentaro Nagai, all of Shizuoka-ken, Japan

[73] Assignee: Yazaki Corporation, Tokyo, Japan

[21] Appl. No.: 09/286,673

[22] Filed: Apr. 6, 1999

[30] Foreign Application Priority Data

Apr. 7, 1998 [JP] Japan ..... 10-094905

[51] Int. Cl.[7] ..... H01R 4/24

[52] U.S. Cl. ..... 439/404; 439/752; 439/701

[58] Field of Search ..... 439/404, 701, 439/752, 521

[56] References Cited

U.S. PATENT DOCUMENTS 5,947,774 9/1999 Abe ..... 439/701

FOREIGN PATENT DOCUMENTS 10-92478 4/1998 Japan .

*Primary Examiner*—Gary F. Paumen
*Assistant Examiner*—Tho D. Ta
*Attorney, Agent, or Firm*—Finnegan, Henderson, Farabow, Garrett & Dunner, L.L.P.

[57] ABSTRACT

A crimp connector is provided with a first housing and a second housing. The first housing has a first bottom wall and a first plurality of partition walls extending in a first direction. The second housing has a second bottom wall and a second plurality of partition walls extending in a second direction substantially parallel to the first direction. The first plurality and second plurality of partition walls align with each other during an assembly of the first and second housings to form the crimp connector. These partition walls also have end portions with a step-like configuration having a protruding portion and a cutout portion. A plurality of accommodating chambers are configured to hold a crimp terminal, each accommodating chamber being defined by the first bottom wall, the second bottom wall, and respective adjacent partition walls of the aligned first plurality of partition walls and second plurality of partition walls. The crimp connector has a center portion defined such that the accommodating chambers are substantially evenly disposed on either side of the center portion. One of the first plurality of partition walls and the second plurality of partition walls has the cutout portions facing away from the center portion of the crimp connector, while the other of the first plurality of partition walls and the second plurality of partition walls has the cutout portions facing toward the center portion.

6 Claims, 8 Drawing Sheets

CRIMP CONNECTOR HAVING STEPPED PARTITION WALLS

BACKGROUND OF THE INVENTION

The present invention relates to a crimp connector for accommodating crimp terminals and more particularly to a crimp connector for preventing an electrical leak caused by dew formation between adjacent terminal accommodating chambers.

Japanese Patent Application Laid-Open No. H10-92478 has disclosed a crimp connector for accommodating crimp terminals in adjacent terminal accommodating chambers.

SUMMARY OF THE INVENTION

According to considerations on this kind of the crimp connector by the inventors of the present invention, a basic structure thereof is summarized as shown in FIGS. 1 to 3.

In FIGS. 1 to 3, a housing of a crimp connector 100 includes a lower housing (one housing) 1 made of synthetic resin and a cover housing (the other housing) 2 made of synthetic resin.

This lower housing 1 has a bottom wall 3 and a plurality of partition walls 4 disposed to line up in one direction and to project from the bottom wall 3 in parallel. The partition wall 4 has a step-like portion 5 comprised of a protruding portion 5*a* and a cutout portion 5*b*.

Prior to assembly of the housings, the lower housing 1 is structured such that a crimp terminal 6 is capable of being installed in a space surrounded by the bottom wall 3 and the adjacent partition walls 4. In FIGS. 1 and 2, the crimp terminals 6 except the space on each of both ends are not shown.

This crimp terminal 6 has a cylindrical contact portion (not shown) which is conductive when a mating terminal is inserted and a crimping portion which is conductive with a conductor 7*a* inside a insulating coating when a crimping blade 6*a* bites into the insulating coating of a wire 7.

On the other hand, the cover housing 2 has a bottom wall 8 and a plurality of partition walls 9 disposed to line up in one direction and project from the bottom wall 8 in parallel and an end of each partition wall 9 has a step-like portion 10 comprised of a protruding portion 10*a* and a cutout portion 10*b*. Hook portions 11 are provided on both ends of the cover housing 2.

With the above described structure, the crimp terminal 6 is accommodated in each space surrounded by the bottom wall 3 of the lower housing 1 and the adjacent partition walls 4 and a wire 7 is positioned from above so that it is set at the crimping portion of this crimp terminal 6, and then a crimping jig (not shown) is descended so as to push the wire 7 into the crimping portion.

By this pushing, the crimping blade 6*a* bites into the insulating coating so that it comes into contact with a conductor 7*a*.

Next, the cover housing 2 is put on the lower housing 1 and then by pressing this cover housing 2 downward, the cover housing 2 is distorted and deformed so that the hook portions 11 on both ends engage the lower housing 1.

With this assembly condition, as shown in FIG. 1, a plurality of terminal accommodating chambers 12 are constructed by the bottom walls 3, 8 and the adjacent partition walls 4, 9.

And, the step-like portions 5, 10 of the partition walls 4, 9 of the lower housing 1 and cover housing 2 mesh with each other.

By this meshing, a creepage distance up to the adjacent terminal accommodating chamber 12 is prolonged so that moisture and rain water become difficult to invade into the adjacent terminal accommodating chamber 12, thereby preventing an electrical leak due to dew formation.

Further, because the opposing end portions of the partition walls 4, 9 mesh with each other, a deviation of the housings relative to each other is prevented.

However, in a process up to such assembly of the housings, when the cover housing 2 is put on the lower housing 1 from the above and the cover housing 2 is pressed downward, there may be generated a distortion and deformation to the cover housing 2.

As a result, as shown by a solid line in FIG. 2, the partition walls 9 located on the right and left sides of the center line CL are deformed so as to leave the center line CL by this distortion, so that the protruding portion 10*a* of the partition wall 9 located to the left side relative to the center line CL may collide with the crimp terminal 6 as shown in FIG. 3. Consequently, the partition walls 9 and crimp terminal 6 may be deformed or damaged thereby possibly leading to an assembly failure.

Such an assembly failure may occur when a warpage is generated as shown in FIG. 2 at the time of molding of the cover housing 2.

Accordingly, the present invention has been achieved by considerations of the inventors of the present invention and therefore, it is an object of the invention to provide a crimp connector capable of effectively preventing an electrical leak due to dew formation and an assembly failure due to distortion and deformation of a housing and a warpage at the time of molding a hosing.

To achieve the above object, a crimp connector according to the present invention is provided with a first housing having a bottom wall and a plurality of partition walls disposed so as to line up in a first direction and projecting in parallel to each other and in which a crimp terminal is disposed, a second housing having a bottom wall and a plurality of partition walls disposed so as to line up in a second direction and projecting in parallel to each other, and a plurality of terminal accommodating chambers disposed so as to line up in a predetermined direction. Each of the plurality of terminal accommodating chambers is defined by the bottom wall of the first housing, the bottom wall of the second housing, and combined and adjacent those of the plurality of partition walls of the first housing and the plurality of partition walls of the second housing, when the first housing and the second housing are assembled together such that the plurality of partition walls of the first housing and the plurality of partition walls of the second housing oppose to each other to make assembly state. Here, each of end portions of the plurality of partition walls of the first housing is formed in a step-like shape having a protruding portion and a cutout portion, and the cutout portion is provided on a side near a center portion along the first direction of the first housing. On the other hand, each of end portions of the plurality of partition walls of the second housing is formed in a step-like shape having a protruding portion and a cutout portion, and the protruding portion is provided on a side near a center portion along the second direction of the second housing.

With such a structure, even when a distortion due to a pressing force at the time of assembly or a warpage at the time of molding exits in the second housing and consequently, the second housing is assembled to the first housing in a state in which the protruding portion is deviated in a direction to leave a center portion of the second housing because of the distortion or the warpage, the partition wall of the second housing can effectively be restrained to collide with a crimp terminal.

Therefore, an assembly failure due to the distortion of the housing or the warpage of molding can be prevented sufficiently and an electrical leak due to dew formation can be sufficiently prevented.

Further, it is permissible that a face, on the cutout portion side, of the protruding portion at the end portion of the plurality of the partition walls of the first housing is in a tapered shape which becomes narrower as it reaches an end of the protruding portion, and that a face, on the cutout portion side, of the protruding portion at the end portion of the plurality of the partition walls of the second housing is in a tapered shape which becomes narrower as it reaches an end of the protruding portion.

With this structure, because the protruding portion of the partition wall is tapered, this protruding portion is easy to enter into the cutout portion of the partition wall of a mating housing in a process of assembly of the housings.

Therefore, the assembly procedure for the housings can be carried out more smoothly.

More specifically, in the crimp connector according to the present invention, in the assembly state, the protruding portion at the end portion of each of the plurality of the partition walls of the first housing corresponds to and engages the cutout portion at the end portion of each of the plurality of the partition walls of the second housing, while the cutout portion at the end portion of each of the plurality of the partition walls of the first housing corresponds to and engages the protruding portion at the end portion of each of the plurality of the partition walls of the second housing.

Further, prior to the assembled state of the housings, the crimp terminal is disposed in the space of the first housing.

Further, the crimp connector according to the present invention may further comprise a third housing having a bottom wall and a plurality of partition walls disposed on the bottom wall to line up in a third direction and project in parallel. In this case, a crimp terminal is disposed in a space defined by the bottom wall of the second housing and adjacent combination of the plurality of the partition walls of the second housing.

DETAILED DESCRIPTION OF THE PREFERRED EMBODIMENTS

Figure 1:
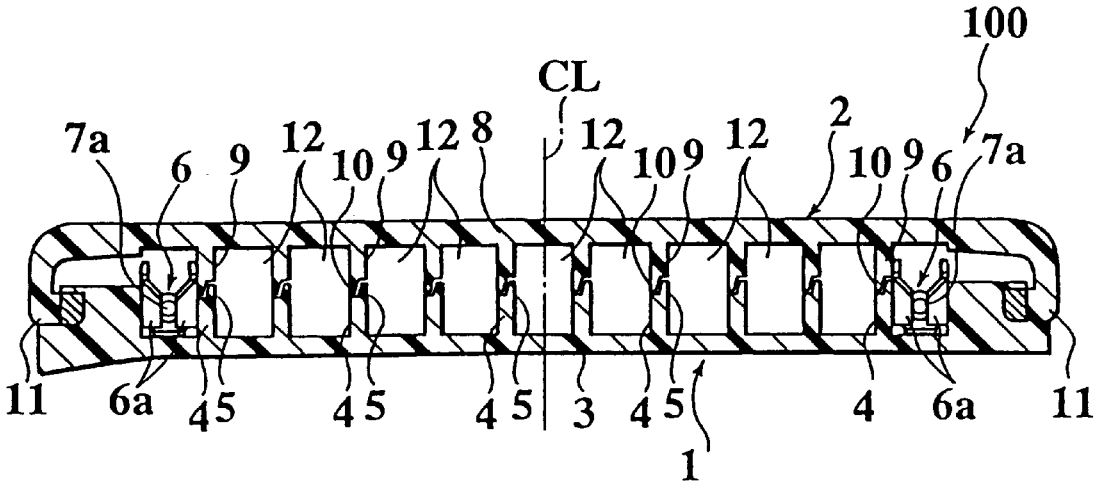
FIG. 1 PRIOR ART
FIG. 1 is a sectional view after housings of a crimp connector considered by the inventor of the present invention are assembled.
Figure 2:
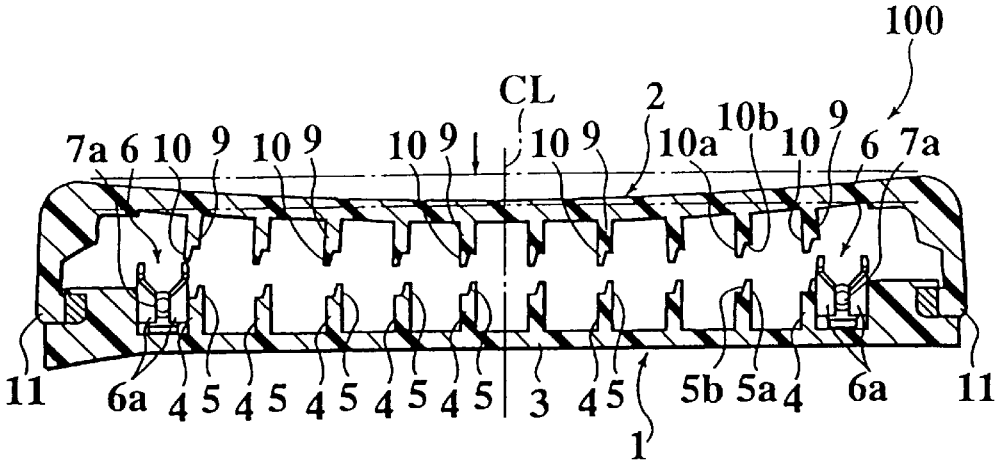
FIG. 2 PRIOR ART
FIG. 2 is a sectional view showing a midway of the assembly process of the housings of the same crimp connector.
Figure 3:
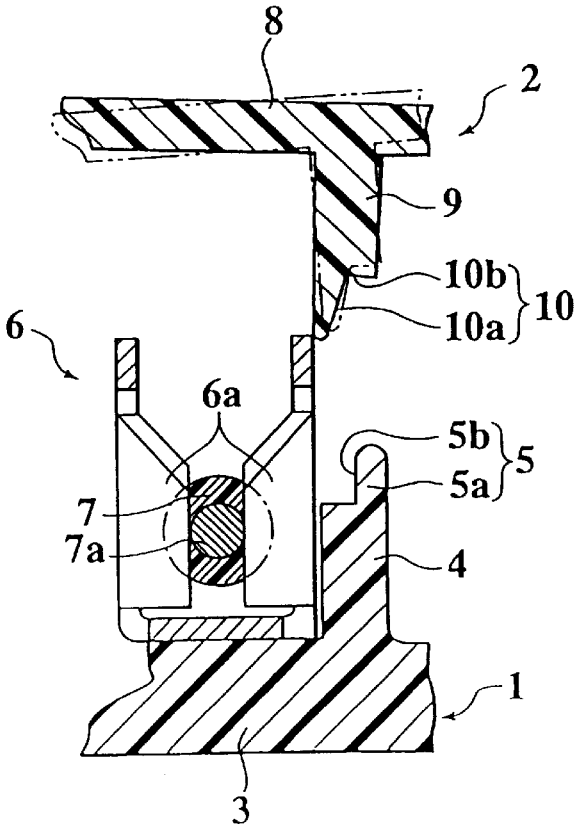
FIG. 3 PRIOR ART
FIG. 3 is an enlarged sectional view of major parts of a portion located to the left side relative to the center line CL in FIG. 1.

Hereinafter, the embodiments of the present invention will be described in detail with reference to the accompanying drawings.

First of all, a crimp connector 100 according to a first embodiment of the present invention will be described with reference to FIGS. 4 to 6. The same reference numerals are attached to the same components as those relating to the considerations of the inventors of the present invention and a description thereof is omitted and only different parts will be described.

Figure 4:
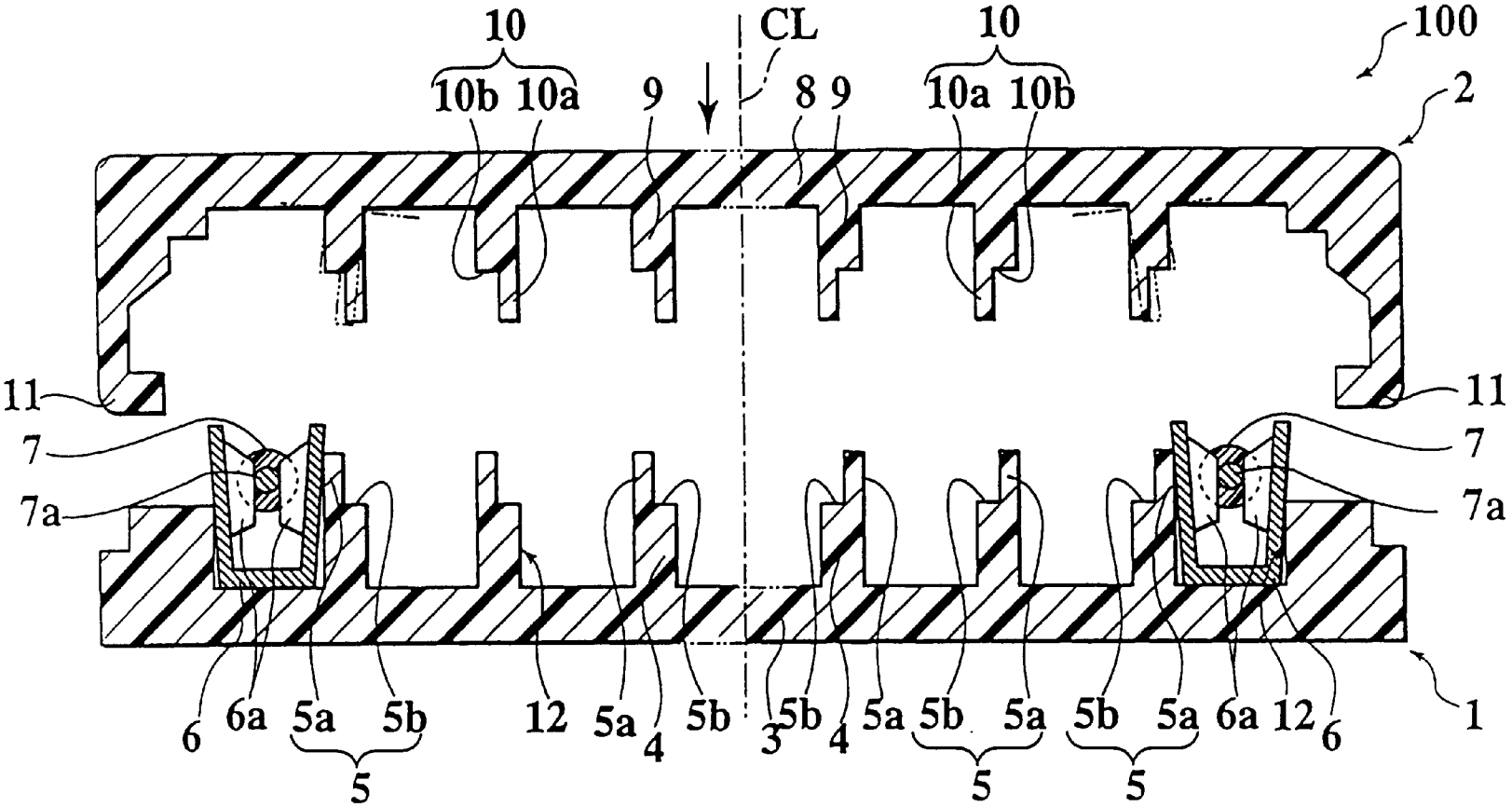
FIG. 4 is a sectional view showing a midway of the assembly process of the housings of the crimp connector according to a first embodiment of the present invention.
Figure 5:
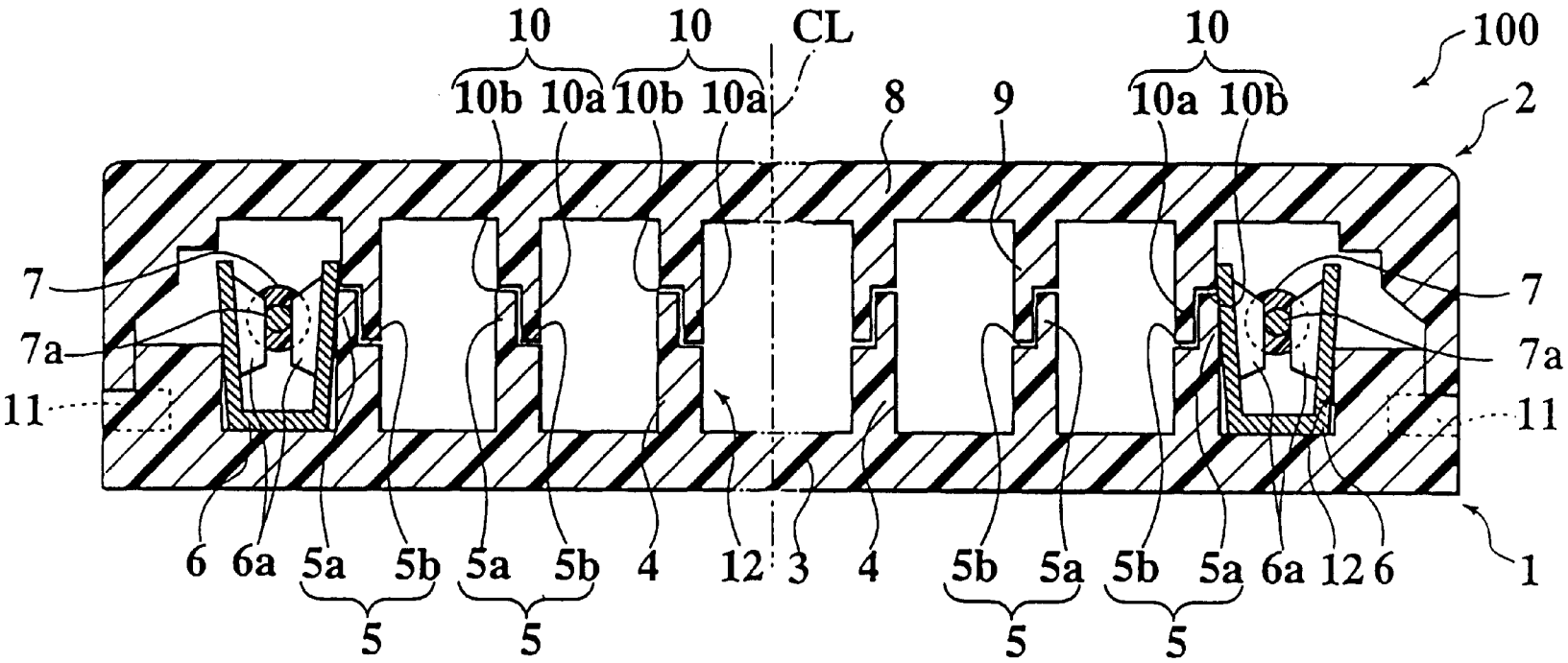
FIG. 5 is a sectional view after the housings of the same crimp connector are assembled.
Figure 6:
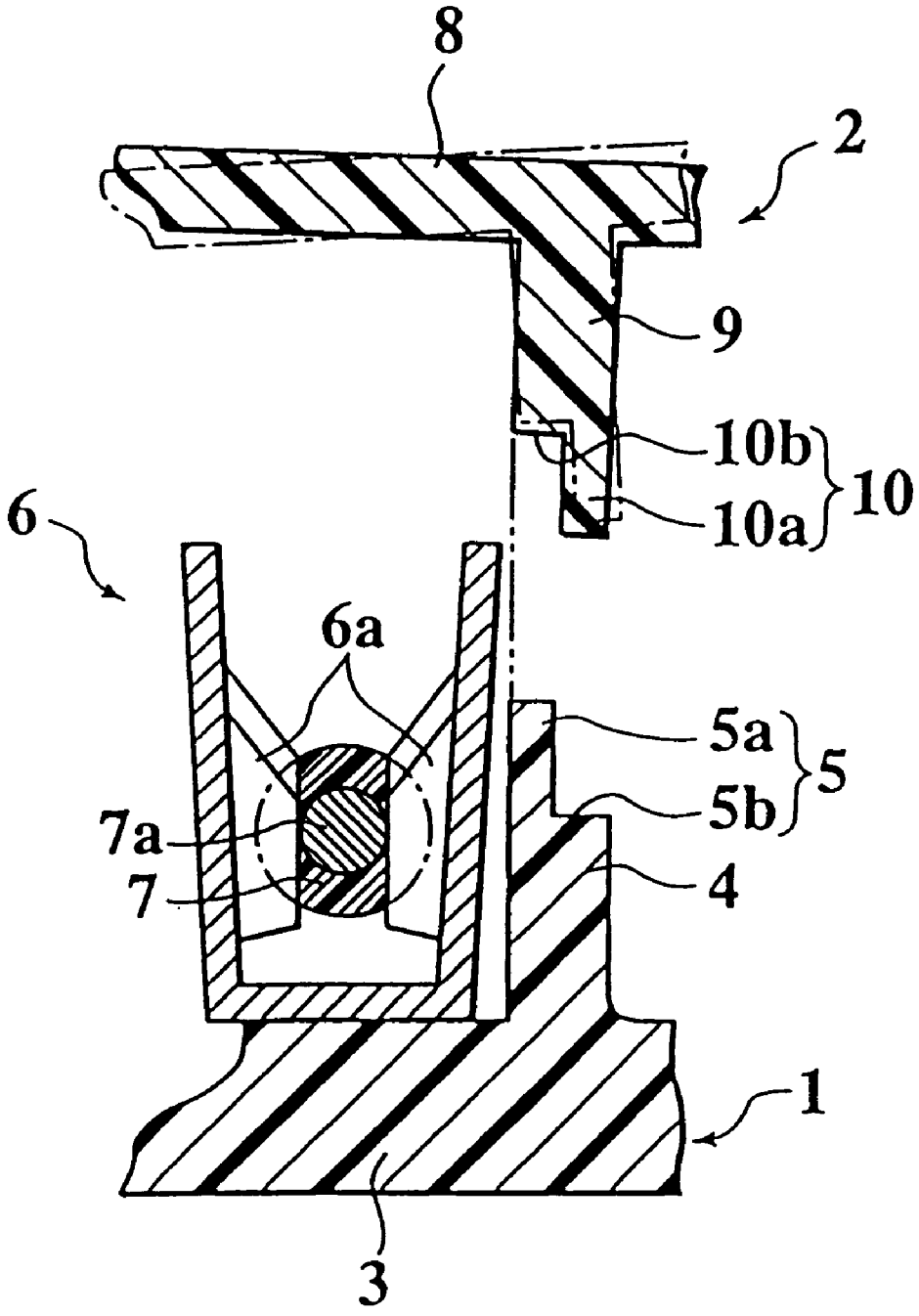
FIG. 6 is an enlarged sectional view of major parts of a portion located to the left side relative to the center line CL in FIG. 4.

Referring to FIGS. 4 to 6, an end (each of opposing end portions) of each of partition walls 4, 9 of a lower housing (one housing) 1 made of synthetic resin and a cover housing (the other housing) 2 made of synthetic resin comprises a step-like portion 5, 10 respectively provided with of a protruding portion 5*a*, 10*a* and a cutout portion 5*b*, 10*b*.

Here, a line passing in the center of a disposition direction of a plurality of the partition walls 4, 9 in the corresponding housings 1, 2 is referred to as a center line CL. The cutout portion 5*b* is disposed on a center line CL side of each step-like portion 5 of the lower housing 1 and the protruding portion 10*a* is disposed on a center line CL side of each step-like portion 10 of the cover housing 2. The step-like portions 5, 10 of the partition walls 4, 9 of the housing 1, 2 are disposed symmetrically with respect to the right and left side of the center line CL.

With such a structure, a crimp terminal 6 is accommodated in each space surrounded by the bottom wall 3 and the adjacent partition walls 4 of the lower housing 1 and a wire 7 is positioned from above such that it is located close to the crimping portion of this crimp terminal 6. Then, a crimping device (not shown) is descended to push the wire 7 in such that the wire 7 is crimped in the crimping portion.

At this time, a pair of crimping blades 6*a* bite into an insulating coating layer of the wire 7 by this pushing and comes into contact with a conductor 7*a* of the wire 7.

Next, the cover housing 2 is put on the lower housing 1 and then the cover housing 2 is pressed downward. As a result, the cover housing 2 is distorted and deformed so that engaging portions 11 on its both ends engage the lower housing 1, thereby completing assembly of the crimp connector 100.

When the assembly is completed, as shown in FIG. 5, the plurality of the terminal accommodating chambers 12 are defined by the bottom walls 3, 8 and the partition walls 4, 9 so that they are arranged in line in a direction parallel to the disposition direction of the partition walls 4, 9.

The step-like portions 5, 10 of the partition walls 4, 9 of the respective lower housing 1 and cover housing 2 mesh with each other.

By this meshing, the creepage distance up to the adjacent terminal accommodating chamber 12 is prolonged so that moisture and rain water become difficult to invade into the adjacent terminal accommodating chamber 12, thereby preventing an electrical leak due to dew formation. Further, because the opposing end portions of the partition walls 4, 9 mesh with each other, deviation of the housing positions can be prevented.

In case that distortion due to a pressing force at the time of assembly or warpage at the time of molding exists in the cover housing 2 in the process up to the assembly completion state of the housings, the partition wall 9 is distorted in a direction in which it goes off the center line CL as shown by a phantom line of FIG. 4 due to the distortion or the warpage. It then comes that, with this state, the cover housing 2 is assembled with the lower housing 1.

However, because according to this embodiment, all the step-like portions 10 of the cover housing 2 have the protruding portions 10*a* on the center line CL side thereof, the partition walls 9 located on the left side of the center line CL as well as the partition walls 9 located on the right side of the center line CL can not collide with the crimp terminals 6 as shown in FIG. 6.

Therefore in the crimp connector of this embodiment, such an assembly failure due to the collision of the partition wall 9 of the cover housing 2 with the crimp terminal 6 can be effectively eliminated.

Next, a crimp connector according to a second embodiment of the present invention will be described with reference to FIGS. 7 and 8. The same reference numerals are attached to the same components as those of the first embodiment, and a description thereof is omitted and only different parts will be described.

Figure 7:
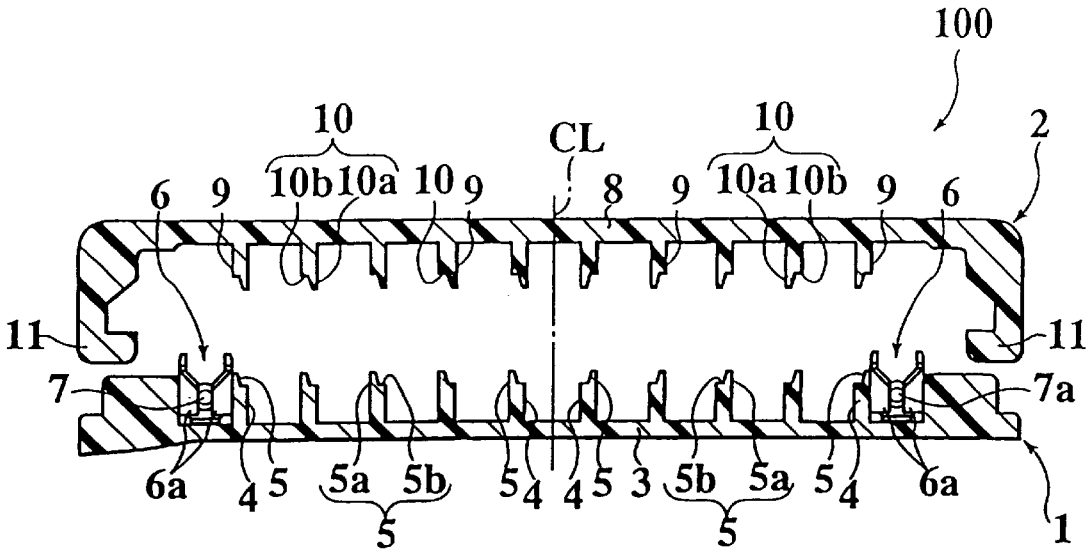
FIG. 7 is a sectional view showing a midway of the assembly process of the housings of the crimp connector according to a second embodiment of the present invention.
Figure 8:
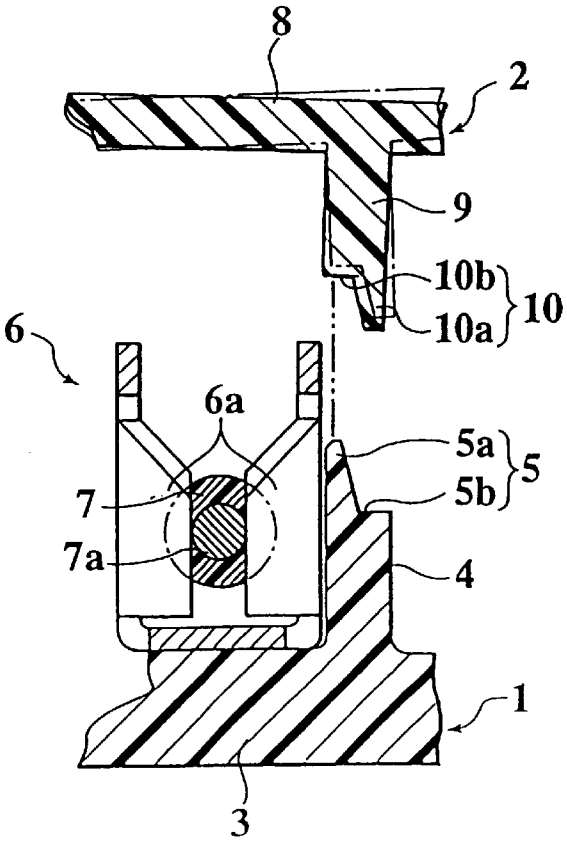
FIG. 8 is an enlarged sectional view of major parts of a portion located to the left side relative to the center line CL in FIG. 7.

As shown in FIGS. 7 and 8, in the crimp connector 100 of this embodiment, the cutout portion side face of each a protruding portion 5*a*, 10*a* and a cutout portion 5*b*, 10*b* of the partition walls 4, 9 of the lower housing (one housing) 1 made of synthetic resin and the cover housing (the other housing) 2 made of synthetic resin is formed in a tapered shape which becomes narrower as it reaches an end thereof.

Therefore, because the protruding portion 10*a* of the partition wall 10 of the cover housing 2 is tapered, this protruding portion 10 is easy to enter into the cutout portion 5*b* of the partition wall 5 of the lower housing 1 in a process of housing assembly so that a smooth assembly can be achieved.

Next, a crimp connector 200 according to a third embodiment of the present invention will be described with reference to FIGS. 9 and 10.

Figure 9:
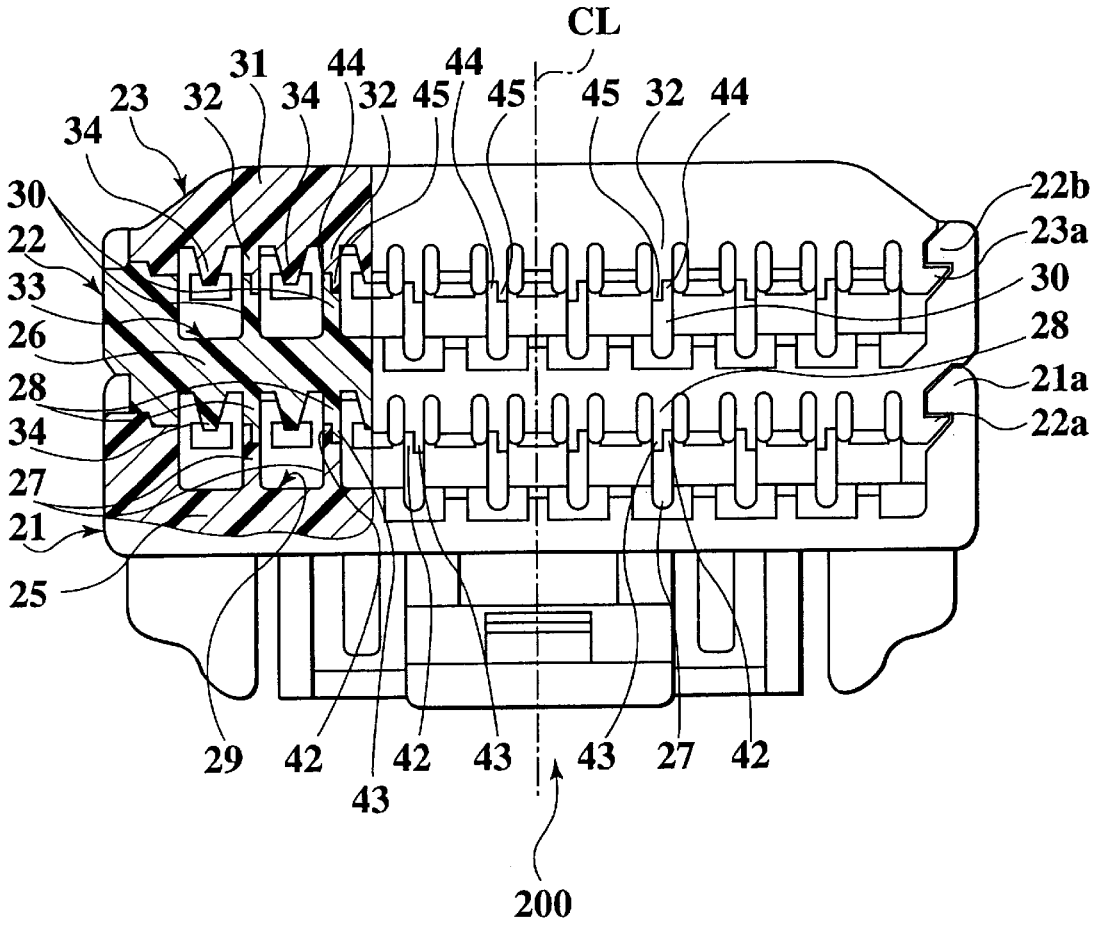
FIG. 9 is a partially broken-away front view of the crimp connector according to a third embodiment of the present invention.
Figure 10:
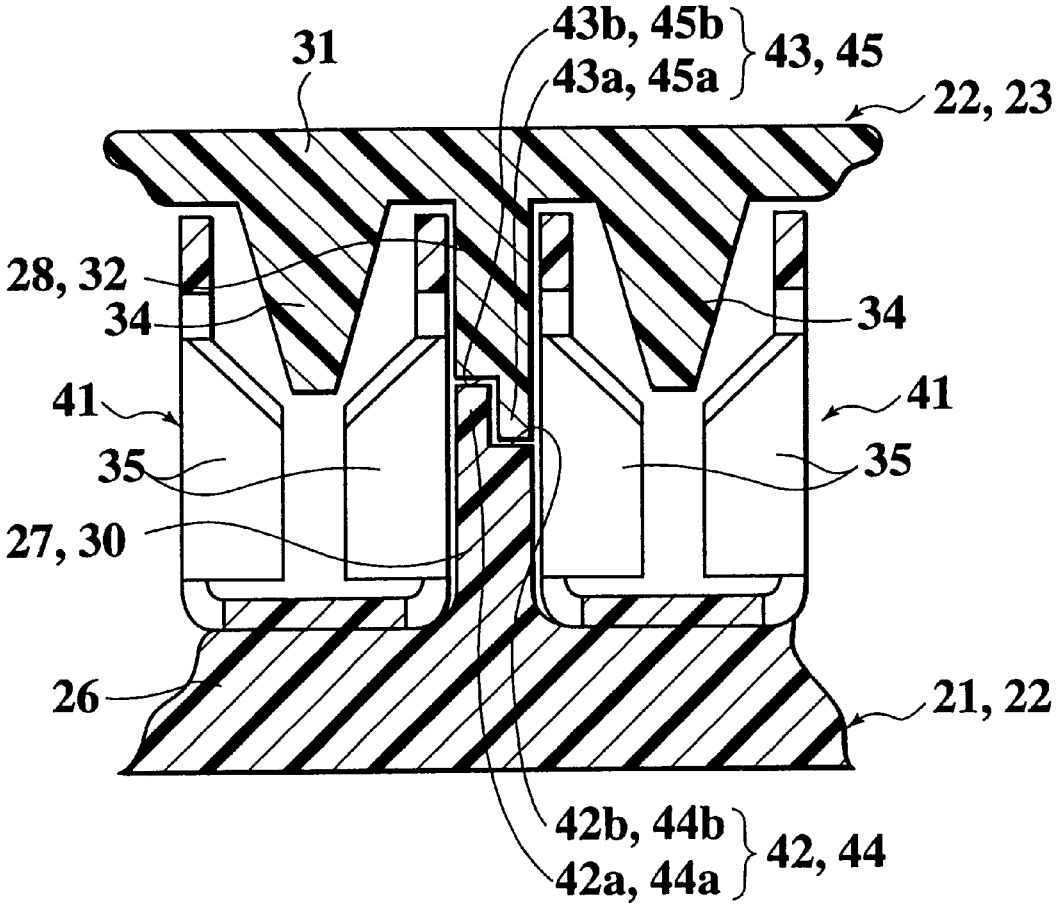
FIG. 10 is an enlarged sectional view of major parts at a portion located to the left side relative to the center line CL in FIG. 9.

Referring to FIGS. 9 and 10, the crimp connector 200 of this embodiment comprises three housings which are joined together vertically. Reference numeral 21 denotes a lower housing made of synthetic resin located at the lowermost portion, reference numeral 22 denotes a upper housing made of synthetic resin located at the middle portion and reference numeral 23 denotes a cover housing made of synthetic resin located at the uppermost portion.

Hook-shaped hook portions 21*a*, 22*a*, 22*b*, 23*a* are formed on opposing portions on both ends of the housings 21, 22, 23. By engaging these hook portions 21*a*, 22*a*, 22*b*, 23*a*, the crimp connector 20 is assembled.

That is, the hook portion 21*a* of the lower housing 21 engages the hook portion 22*a* of the upper housing 22 and the hook portion 23*a* of the cover housing 23 engages the hook portion 22*b* of the upper housing 22 provided together with the hook portion 22*a*. By the corresponding engagements of these components, the housings 21, 22, 23 are assembled.

In this embodiment, each of the lower housing 21 and upper housing 22 serve as a mating housing and on the other hand, each of the upper housing 22 and cover housing 23 serve as a mating housing.

The lower housing 21 and upper housing 22 have bottom walls 25, 26 extending horizontally and a plurality of partition walls 27, 28 disposed to project from the bottom walls 25, 26 in the direction toward the corresponding mating housing.

The partition walls 27, 28 of the respective housings 21, 22 oppose to each other, and when the housings 21, 22 are assembled together, the opposing partition walls 27, 28 come into contact with each other. The terminal accommodating chamber 29 is formed by surrounding with the partition walls 27, 28 and bottom walls 25, 26.

In a relation between the lower housing 21 and upper housing 22, the bottom wall 26 acts as a ceiling wall.

Further, in the relation between the lower housing 21 and upper housing 22, the lower housing 21 is one housing and the upper housing 22 is the other housing.

More in detail, step-like portions 42, 43 comprised of protruding portions 42*a*, 43*a* and cutout portions 42*b*, 43*b*, are provided on opposing end portions of the partition walls 27, 28 of the lower housing 21 and upper housing 22 so as to mesh with each other.

When a line passing the center of the disposition direction of the plurality of the partition walls 27, 28 is assumed to be a center line CL in each housing 21, 22, the cutout portion 42*b* is disposed on the center line CL side of each step-like portion 42 of the lower housing 21 and on the other hand, the protruding portion 43*a* is disposed on the center line CL side of each step-like portion 43 of the upper housing 22.

This is the same as the relation between the upper housing 22 and cover housing 23. A partition wall 30 is erected from the bottom wall 26 of the upper housing 22 in a direction toward the cover housing 23. The cover housing 23 has a bottom wall 31 extending horizontally and a plurality of the partition walls 32 are erected from the bottom wall 31 in the direction toward the upper housing 22.

Then, by assembling the housings 22, 23, the terminal accommodating chambers 33 surrounded by the partition walls 30, 32 and the bottom walls 26, 31 are formed.

In a relation between the upper housing 22 and cover housing 23, the bottom wall 31 acts as a ceiling wall.

Further, in the relation between the upper housing 22 and cover housing 23, the upper housing 22 is one housing and the cover housing 23 is the other housing.

Then, step-like portions 44, 45 comprised of the protruding portions 44*a*, 45*a* and cutout portions 44*b*, 45*b*, which are to correspondingly mesh with each other, are provided on opposing end portions of the respective partition walls 30, 32 of the upper housing 22 and cover housing 23.

When a line passing the center of the disposition direction of the plurality of the partition walls 30, 32 is assumed to be a center line CL in each housing 22, 23, the cutout portion 44*b* is disposed on the center line CL side of each step-like portion 44 of the upper housing 22 and on the other hand, a protruding portion 45*a* is disposed on the center line CL side of each step-like portion 45 of the cover housing 23.

Housings located upper of the housings 21, 22, 23 to be assembled, namely, the upper housing 22 and cover housing 23 each have a pushup protrusion 34 erected in a direction toward the mating housings 21, 22 and the pushup protrusions 34 are formed so as to oppose to the terminal accommodating chambers 29, 33. Upon assembly of the housings, this pushup protrusion 34 crimps a wire (not shown) to the crimp terminal 41.

That is, according to the present embodiment, the terminal accommodating chambers 29, 33 are formed in two stages, that is, the upper and lower stages, and the plurality of the terminal accommodating chambers 29, 33 are respectively arranged horizontally in this condition.

The crimp terminal 41 is respectively inserted into the terminal accommodating chambers 29, 33. The crimp terminal 41 has the same structure as the first and second embodiments, and referring to FIG. 10, reference numeral 35 denotes a crimping blade which bites a wire.

In this embodiment in which the terminal accommodating chambers 29, 33 are formed in two stage, upper and lower also, at the time of assembly of the housings 21, 22, 23, the partition walls 28, 32 of the upper housing 22 and cover housing 23 can be effectively restrained to collide with the crimping terminal 41 like the first and second embodiments, of course.

Therefore, there can be sufficiently restrained to occur such an assembly failure caused when the partition walls 28, 32 of the upper housing 22 and cover housing 23 collide with the crimping terminal 41.

What is claimed is:

1. A crimp connector having:

at least a first housing and a second housing, said first housing having a first bottom wall and a first plurality of partition walls extending therefrom in a first direction and said second housing having a second bottom wall and a second plurality of partition walls extending therefrom in a second direction substantially parallel to the first direction, said first plurality of partition walls and said second plurality of partition walls aligning with each other during an assembly of said first and second housings to form the crimp connector and having end portions with step-like configurations having a protruding portion and a cutout portion; and a plurality of terminal accommodating chambers each configured to hold a crimp terminal, each accommodating chamber being defined by said first bottom wall, said second bottom wall, and respective adjacent partition walls of said aligned first plurality of partition walls and second plurality of partition walls during assembly of said at least first housing and second housings to form the crimp connector, said crimp connector having a center portion defined such that said accommodating chambers are substantially evenly disposed on either side of said center portion, wherein one of said first plurality of partition walls and said second plurality of partition walls has said cutout portions facing away from said center portion of the crimp connector and the other of said first plurality of partition walls and said second plurality of partition walls has said cutout portions facing toward said center portion of the crimp connector.

2. The crimp connector according to claim 1, wherein said protruding portions of said end portions have a tapered shape that narrows in a direction toward free ends of the partition walls.

3. The crimp connector according to claim 1, wherein the respective protruding portions of said end portions of said first plurality of partition walls correspond to and engage with the respective cutout portions of said end portions of said second plurality of partition walls when said first housing and said second housing are assembled to form the crimp connector.

4. The crimp connector according to claim 1, wherein at least one crimp terminal is disposed such that its terminal ends oppose one of said first plurality of partition walls and said second plurality of partition walls prior to assembly of the first and second housings to form the crimp connector, said plurality of partition wall facing said terminal ends having said cutout portions facing away from said center portion of the crimp connector.

5. The crimp connector according to claim 1, wherein prior to the assembly of the first housing with the second housing to form the crimp connector at least one crimp terminal is disposed in a space defined by the bottom wall and respective adjacent partition walls of one of said first and second housings and said cutout portions of respective said one of the first and second plurality of partition walls face toward the center portion of the crimp connector.

6. The crimp connector according to claim 1, further comprising a third housing having a bottom wall and a plurality of partition walls disposed so as to line up in a third direction substantially parallel to said first and second directions, said third housing for assembly with at least one of said first and second housings, and forming a second plurality of crimp terminal accommodating chambers with at least one of said first and second housings.

* * * * *

UNITED STATES PATENT AND TRADEMARK OFFICE

CERTIFICATE OF CORRECTION

PATENT NO. : 6,089,901
DATED : July 18, 2000
INVENTOR(S) : Hatagishi et al.

It is certified that error appears in the above-identified patent and that said Letters Patent is hereby corrected as shown below:

Claim 4, column 8,
Line 27, "wall" should read -- walls --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*